United States Patent [19]

Salvino

[11] 4,320,899

[45] Mar. 23, 1982

[54] BOWLING BALL

[76] Inventor: Carmen M. Salvino, 2658 N. New England, Chicago, Ill. 60635

[21] Appl. No.: 124,393

[22] Filed: Feb. 25, 1980

[51] Int. Cl.[3] ..... A63B 37/10

[52] U.S. Cl. ..... 273/63 E; 273/63 C

[58] Field of Search ..... 273/63 R, 63 A, 63 B, 273/63 C, 63 D, 63 E

[56] References Cited

U.S. PATENT DOCUMENTS

| | | | |
|---|---|---|---|
| 189,674 | 4/1877 | Woods | 273/63 A |
| 3,865,369 | 2/1975 | Randolph | 273/63 E |
| 4,121,828 | 10/1978 | Amburgey | 273/63 C |
| 4,131,277 | 12/1978 | Randolph | 273/63 D |
| 4,264,071 | 4/1981 | Randolph | 273/63 E |

*Primary Examiner*—George J. Marlo

*Attorney, Agent, or Firm*—Fay & Sharpe

[57] ABSTRACT

A bowling ball construction in which in the preferred embodiment a pair of weight blocks are provided internally in the ball to compensate for weight removed from the ball in drilling finger and thumb holes. The weight blocks are positioned so as to be intersected by the finger and thumb holes when drilled. As a result, there is no concentrated residual weight in the ball after drilling. The size of the weight blocks and the density thereof are selected so that after drilling, any axis of the ball may be spin axis with moments of inertia about principal axes being approximately equal and products of inertia about axes perpendicular to the spin axis being vanishingly small. Thus, the ball exhibits stability without wobble as it slides and rolls down a lane.

31 Claims, 15 Drawing Figures

FIG. 1
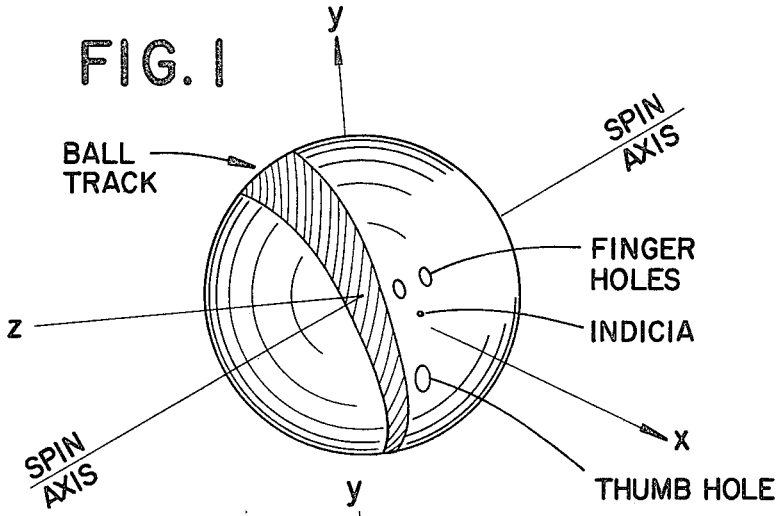
FIG. 2
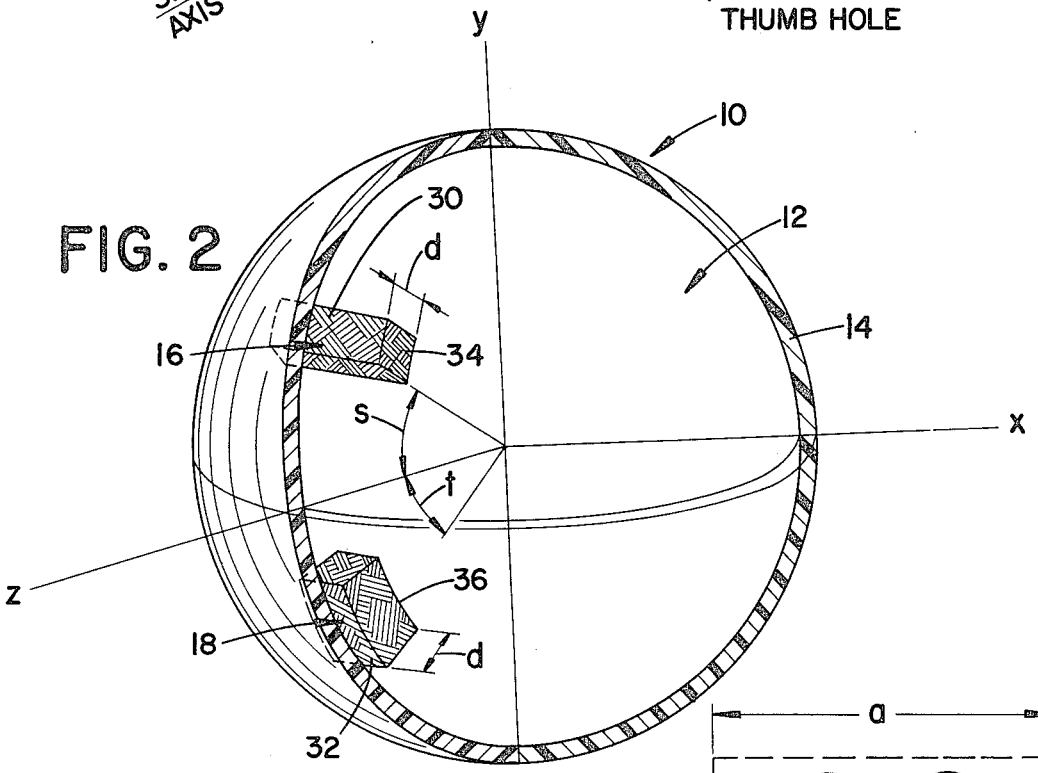
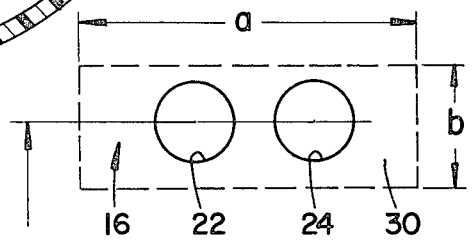
FIG. 4
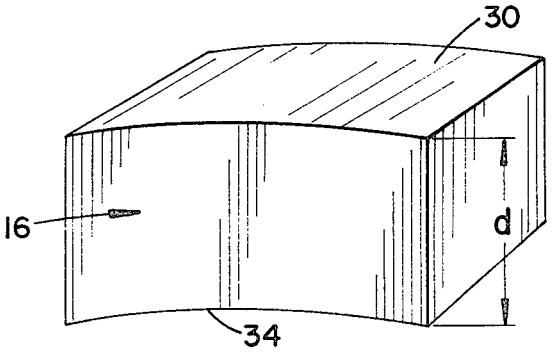
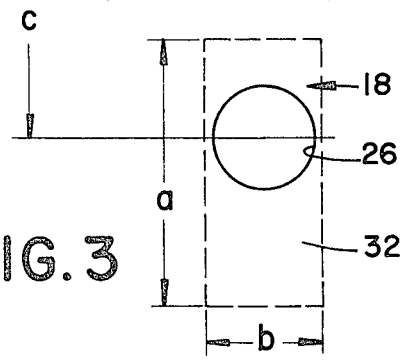
FIG. 3

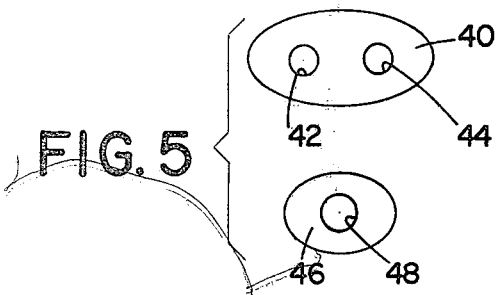
FIG. 5
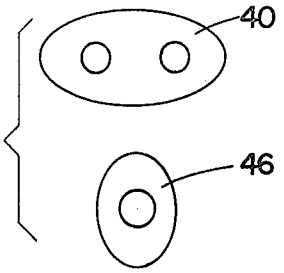
FIG. 6
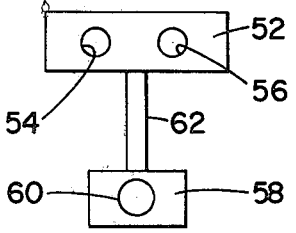
FIG. 7
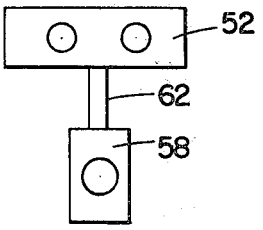
FIG. 8
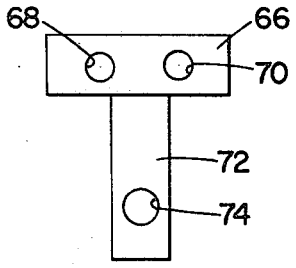
FIG. 9
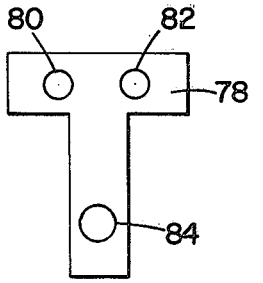
FIG. 10
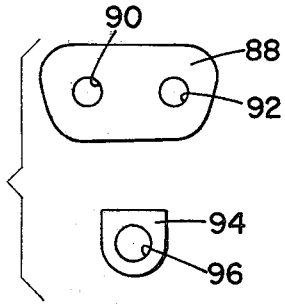
FIG. 11
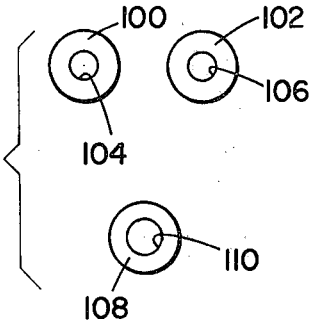
FIG. 12
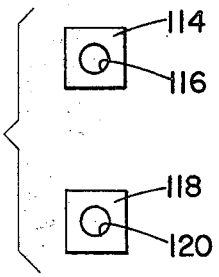
FIG. 13
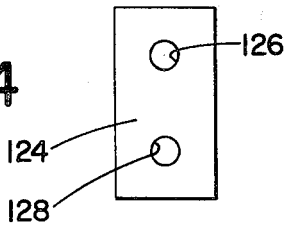
FIG. 14
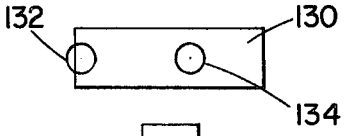
FIG. 15
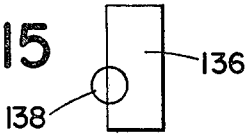

BOWLING BALL

BACKGROUND OF THE INVENTION

The bowling ball which is in popular use in this country is of a weight not to exceed 16 pounds and of an outside diameter of approximately 8.550 to 8.595 inches. The ball is drilled to provide a grip for the bowler. A two (2) hole or three (3) hole grip is generally used. A two (2) hole grip accommodates the thumb and middle finger of the bowler. A three (3) hole grip accommodates the thumb, ring finger and middle finger of the bowler. In a three (3) hole grip, the holes for the ring finger and middle finger may either be drilled shallow (i.e., to the first knuckle) to provide a fingertip grip or deep (i.e., to the second knuckle) to provide a conventional grip. Alternately, grips for which the fingers are inserted to intermediate positions between the first and second knuckle are referred to as semi-fingertip grips. The drilling of holes in the ball, of necessity, removes material from the ball and accounts for unbalanced conditions in what would otherwise be a homogenous ball.

Various methods and apparatus have been proposed in the prior art to compensate for the weight removed by drilling finger and thumb holes. Traditionally, a form of weight block has been incorporated into the design of prior art bowling balls. It has been generally thought that the center of gravity of the ball should be slightly off the geometric center during manufacture of the ball so that after drilling the finger and thumb holes, the ball will be reasonably balanced. To date, the balance of a bowling ball has been measured generally by means of a beam balance scale. Therefore, the balance explored is necessarily a static phenomenon. Little attention has been directed at the dynamic balance properties of bowling balls.

A bowling ball that is not dynamically balanced will, among other things, wobble as it is rolled down a lane. Evidence of wobble behavior can be seen in the flared nature of the resulting ball track on the exterior surface of the ball. Wobble behavior can also be observed by a trained individual standing at the foul line or on carefully obtained high speed films.

A wobble condition due to dynamic imbalance in the ball produces numerous variables which affect the ability of the bowler to consistently use the ball to obtain high scores. Bowling with a consistently high degree of scoring requires accurate placement of the ball in the strike zone. When a spare is desired, a high degree of accuracy is required in order to knock over a pin or, in some cases, achieve a desired degree of pin action in order to knock over a number of standing pins. Dynamic imbalance in the ball impedes the ability of the bowler to control his game.

There is a large number of variables in the game of bowling some of which are under the control of the bowler and some of which are out of the bowler's control. Variables within the control of the bowler include the form utilized by the bowler to throw the ball, the grip and delivery of the bowler, the equipment selected by the bowler including the ball and shoes, and the ability of the bowler to place the ball at an intended target. Variable factors encountered by the bowler over which he has little or no control include the conditions of the lane including the surface finish, the oil coating on the lane surface, the interaction of the ball with the lane surface and the interaction of the ball with the pins after striking the pins. The ability of a bowler to compensate for lane conditions is important. Thus, the ability to accurately control movement of the ball under various conditions can result in improved or higher scores.

It is a general object of this invention to provide a bowling ball which includes weight blocks having desired properties and which are so positioned relative to the finger holes and thumb hole that the ball will exhibit a stable trajectory as it rolls and slides down the lane.

The preferred embodiment of the invention will be described with reference to the accompanying figures in which:

FIG. 1 is a schematic view of a bowling ball showing a spin axis and axes of the ball aligned with the grip;

FIG. 2 is a schematic representation (partly in section) of the preferred embodiment of the bowling ball of this invention and showing the position and location of the weight blocks;

FIG. 3 is a schematic representation of the preferred embodiment showing the relationship of the weight blocks to the finger holes and thumb hole;

FIG. 4 is a perspective view of a weight block of the preferred embodiment of this invention.

FIGS. 5–14 are schematic representations similar to FIG. 3 and showing modified embodiments of the bowling ball of this invention particularly with respect to the relationship of the weight blocks to the finger holes and thumb hole; and FIG. 15 is a schematic representation, similar to FIG. 3, and showing a portion of the preferred embodiment of the bowling ball of this invention in which the finger and thumb holes overlie both a respective weight block and a portion of the core of the ball.

MATHEMATICAL ANALYSIS OF THE DYNAMICS OF BOWLING BALLS

It is considered desirable for a bowling ball to exhibit a stable trajectory after it is thrown by a bowler. By stable trajectory it is meant one in which the ball does not wobble as it rolls and slides down the lane. Wobble in a bowling ball is the consequence of dynamic imbalance properties which result either from weight removed by drilling finger and thumb holes in the ball as it is fitted to the hand of the bowler using the ball or, alternately, because of dynamic imbalance characteristics placed in the ball at the time of manufacture.

To appreciate the importance of dynamic balance properties of bowling balls, attention will first be directed to a discussion of the inertia properties of a spherical body.

The inertia tensor is a complete mathematical representation of the dynamic properties of rigid bodies. The inertia tensor may be represented as:

| | | |
|---|---|---|
| $I_{xx}$ | $I_{xy}$ | $I_{xz}$ |
| $I_{xy}$ | $I_{yy}$ | $I_{yz}$ |
| $I_{xz}$ | $I_{yz}$ | $I_{zz}$ |

Dynamic properties of rigid bodies cannot be examined through the use of static balance scales. Rather, dynamic properties must be measured while the rigid body is forced through a prescribed rotary motion.

The diagonal terms in the tensor described above are called moments of inertia and are a measure of an object's resistance to rotary motion. The off-diagonal terms are called products of inertia and are a measure of an object's resistance to tumbling about a secondary axis.

Consider the experiment in which a solid sphere or ball is constrained to rotate only about the z axis.

The equations of motion are:

$$\Sigma M_x = -I_{xz}\dot{w}_z + I_{yz}w_z \quad 2$$

$$\Sigma M_y = -I_{yz}\dot{w}_z - I_{xz}w_z^2$$

$$\Sigma M_z = I_{zz}\dot{w}_z$$

Note that the last equation involves only the moment of inertia $I_{zz}$ and expresses the resistance of the body to generate an angular acceleration $\dot{w}_z$ when subjected to an applied moment $\Sigma M_z$. If the body is set in motion so that $\dot{w}_z=0$ (i.e., steady angular velocity $\dot{w}_z$) then two moments: $\Sigma M_x=I_{xz}w_z^2$ and $\Sigma M_y=-I_{yz}w_z^2$ must be applied to maintain this planar motion.

If these moments (i.e., $\Sigma M_x$ and $\Sigma M_y$) are not supplied, the spherical body or ball will tend to tumble about the secondary axes x and y producing an erratic pattern of motion. Imposed rotations about other axes would involve other combinations of the inertia properties.

An examination of the inertia properties of bowling balls indicates that the moments of inertia for a set of axes centered on the center of gravity and aligned with the grip are approximately equal. Furthermore, the products of inertia for this set of axes are very close to zero for all prior art weight block designs. For any design of a rigid spherical body which exhibits symmetry properties about the x axis the resulting products of inertia will become vanishingly small. The spherical body will not exhibit a tendency to tumble or wobble when spun about the z axis.

The above observations explain why the "full roller" bowling ball exhibits an extremely stable trajectory with the resulting ball path being smooth. However, when a bowler throws a hook or curve ball, the path of the ball is not a full roller, the spin axis is not an axis of symmetry and the products of inertia do not vanish. Accordingly, wobble results.

In FIG. 1, there is shown a bowling ball in which the set of axes x, y and z are centered on the center of gravity of the ball and are aligned with the grip or the finger and thumb holes. In a "full roller", the spin axis of the ball will be the z axis of FIG. 1. Because of the symmetry of the grip, (i.e., the holes) with respect to the x, y and z axes, the "full roller" exhibits an extremely stable trajectory and the resulting ball path is smooth as indicated above. However, when the bowler throws a hook or curve, the ball path is not a full roller, the spin axis is not the z axis (an axis of symmetry with respect to the grip) and the products of inertia do not vanish.

With reference to FIG. 1, a bowler who throws a hook or curve will impart an angular velocity to the ball about an axis which is denoted the "spin axis" in FIG. 1. When rotated about the spin axis, the products of inertia force the ball to wobble about the secondary axes. Evidence of this behavior can be seen in the flared nature of the resulting ball track which is shown in FIG. 1. The ball track is the surface of the ball which comes in contact with the lane after the ball is thrown. As will be observed in FIG. 1, the ball track exhibits one of the possible flare patterns having a relatively narrow width at the bottom of FIG. 1 and a relatively wide width at the top of FIG. 1. A ball that exhibits a stable trajectory and without wobble can be expected to have a ball track that has a substantially uniform width throughout its circumference.

Having determined that a ball which exhibits a nonstable trajectory is, in fact, dynamically out of balance, it was then possible to outline criteria for a design concept which produces a ball having a stable trajectory with a resulting smooth ball path. Simply stated, it was determined that a bowling ball will be stable in which every axis can be a spin axis with the moments of inertia equal for axes aligned with the spin axis and the products of inertia extremely small for axes perpendicular to the spin axis. In order to achieve this design concept, it became necessary to examine structures by which every axis of the ball could be a spin axis.

Weight Block Concept

Description of the Preferred Embodiment

Applicant's weight block concept was designed for the purpose of making all axes equal (i.e., making any axis of the ball a potential spin axis with the resulting moments of inertia for axes aligned with the spin axis equal and the products of inertia for axes perpendicular to the spin axis extremely small.)

With reference to FIG. 2, the preferred embodiment of applicant's weight block concept incorporates a pair of generally rectangular weight blocks in the ball in a location so as to be intersected by the finger and thumb holes.

There is shown in FIG. 2 a bowling ball 10 which, in the preferred embodiment, is of a size and weight approved by the American Bowling Congress. Accordingly, the preferred embodiment of applicant's weight block structure is shown with respect to a bowling ball approximately 8.5 inches in outside diameter and approximately 16 pounds in weight. The bowling ball of FIG. 2 is made up of a generally homogenous core 12 and a cover 14.

In the preferred embodiment of FIG. 2, the core 12 has an outside diameter of approximately 7.75 to 8.00 inches. Core 12 is surrounded by cover 14 which, due to the fact that the outside diameter of the ball is approximately 8.5", has a radial thickness of approximately 0.3 inches. Core 12 may be made up of any suitable polymeric or rubber material. Similarly, the cover 14 may be made up of any suitable polymeric or rubber material producing desired surface characteristics (hardness, etc.) for the ball. In the preferred embodiment, the core density is approximately 0.0505 lbs./cubic inch. The cover density, in the preferred embodiment, is less than the core density. The cover, in the preferred embodiment, has a density of approximately 0.0430 lbs./cubic inch.

Positioned within core 12 of FIG. 12 is a pair of weight blocks. Block 16 denotes the finger block. Block 18 denotes the thumb block. Blocks 16 and 18 are labelled the finger and thumb blocks for the reason that they are designed to be intersected by the finger holes and thumb hole, respectively, at the time the ball is drilled.

With reference to FIG. 3, the finger block 16 and thumb block 18 are shown in phantom in relation to the finger holes 22, 24 and the thumb hole 26 in a three hole grip. The block 18 of FIG. 3 is oriented generally 90 degrees relative to the block 16 producing an approximate tee configuration. It will be seen from FIG. 3 that the finger block 16 has a length dimension "a" which is sufficient to permit the finger block to encompass both of the finger holes 22, 24 but yet allow for variations in the distance between the finger holes to suit an individual bowler. It should be appreciated that the precise location of the finger holes will vary for each bowler depending upon the size of the bowlers hand, grip preferences, etc. Accordingly, the length dimension "a" of finger block 16 of FIG. 3 is selected so as to allow some variation insofar as the placement of the finger holes 22, 24.

The thumb block 18 of FIG. 3 is similarly provided with a longitudinal dimension "a" which permits some up and down variation (as seen in FIG. 3) insofar as the placement of the thumb hole 26.

In the preferred embodiment as shown in FIG. 3, the span distance "c" is approximately 4 inches. Span distance "c" is the approximate arcuate distance from the centerline of the finger holes 22, 24 to the centerline of the thumb hole 26. The longitudinal dimension "a" of the thumb block 18 is sufficient to give a span range "c" of 3–6 inches depending upon the grip characteristics of the bowler.

Again with reference to the thumb block 18, the width dimension "b" is selected to be slightly greater than the diameter of the thumb hole 26. The width dimension "b" of the finger block 16 is selected to be in excess of the diameter of either one of the finger holes.

In the preferred embodiment of the invention, the finger block and thumb block have equal dimensions. That is to say, the longitudinal dimension "a" of the finger block 16 is approximately equal to the longitudinal dimension "a" of the thumb block 18. Similarly, the width dimensions "b" of each of the blocks 16, 18 are approximately equal. Also in the preferred embodiment the weight blocks are of equal size, equal volume and equal weight.

The preferred embodiment of the invention is shown in relation to a three hole grip (thumb, middle finger and ring finger) in which a pair of blocks are intersected by the respective holes. It should be understood that the invention is also applicable to a two hole grip or, indeed, any other grip in which a plurality of holes are drilled into the ball.

With reference to FIGS. 2 and 4, it will be seen that the outer surfaces 30, 32 of the respective blocks 16, 18, are generally spherical in shape. The respective blocks are adapted to be located, in the preferred embodiment, in the core 12 of the ball such that the surfaces 30, 32 are positioned substantially in the same plane as the outer surface of the core 12 as shown in FIG. 2. Thus, in the preferred embodiment, surfaces 30, 32 are positioned substantially adjacent the internal surface of cover 14. In alternate embodiments of the invention the blocks could be positioned deeper into the core 12 than shown in FIG. 2 so that the surfaces 30, 32 are recessed into the core. Alternately, the blocks could be positioned partially in the cover 12 and partially in the core 14 such that the surfaces 30, 32 are located in the cover.

As will be observed from FIGS. 2 and 4, there is a depth dimension in the weight blocks. The depth or thickness of the weight blocks is designated "d". In the preferred embodiment, the thickness "d" of block 18 is approximately equal to the thickness "d" of block 16. In alternate embodiments of the invention the depth of the respective blocks may not be equal.

The under surfaces 34, 36 of the respective blocks 16, 18 are spherical in shape in the preferred embodiment although it should be appreciated that such surfaces, along with upper surfaces 30, 32 could be planar if desired.

Although the dimensions of the weight block may vary to suit individual requirements, in the preferred embodiment of the invention the dimensions of weight block 16 equal the dimensions of weight block 18. With reference to FIG. 3, the length or longitudinal dimension "a" of the respective weight blocks is equal to approximately 2.5 inches. The width dimension "b" of each of the weight blocks in the preferred embodiment, is equal to approximately 1.25 inches. Finally, the thickness or depth dimension "d" of each of the weight blocks is equal to approximately 1.25 inches. By maintaining equal dimensions in the respective weight blocks 16, 18, manufacturing is simplified as a single block can be used as either a finger block or a thumb block.

With reference again to FIG. 2, the x, y and z axes of the bowling ball are shown. The finger block 16 and the thumb block 18 are positioned such that the plane defined by the y-z axes intersects the centroids of the respective blocks 16, 18. The blocks 16, 18 are, thus, otherwise symmetrical with respect to such plane.

Again with reference to the plane defined by the y-z axes of FIG. 2, the centroid of the finger block 16 is positioned approximately at an angle "s" relative to the z axis. In the preferred embodiment angle "s" is equal to approximately 26.68 degrees. Similarly, the centroid of the thumb block 18 is positioned at an angle with respect to the z axis. This angle is shown at the angle "t" in FIG. 2 and, in the preferred embodiment, is approximately 26.68 degrees.

The two weight block ball of the preferred embodiment of this invention provides a significant advancement in the balancing of bowling balls. Since each weight block is located relatively close to the anticipated position of the holes for the fingers and thumbs, the drilled ball will be balanced with respect to the counterweight position over the surface of the ball.

Since in a fingertip grip the thumb hole is generally deeper than the finger holes by approximately a factor of two, the center of gravity of the thumb hole weight (after drilling) is deeper than the finger hole weight (after drilling) by the same factor of two. In the ball of the preferred embodiment of the invention, identical weight blocks (having approximately equal weights) are used since approximately equal weights are removed in the two finger holes and at the thumb hole.

While in the preferred embodiment of the invention the weight blocks are identical both in size and in density, it should be recognized that it is possible to individually size and shape the two weight blocks or to use blocks of different densities and weight to provide a differential center of gravity. Thus in alternate embodiments, it is possible to use weight blocks having identical densities but different thicknesses. For example, the finger block could be approximately 1.0 inches thick while the thumb block could be approximately 1.5 inches thick.

The effective weight of the weight block is dependent upon the density difference between the core and the weight block material as well as the volume of the weight block.

A rectangular shape in the weight blocks was selected in the preferred embodiment in order to provide for variations in the location of the finger holes and thumb hole as was discussed above in connection with FIG. 3. It should be appreciated, however, that other shapes of weight blocks may be used since the inertia factors which produce stability (or instability) in the trajectory of the ball are principally dependent upon volume and weight considerations while shape is a secondary consideration. Since the concept of the preferred embodiment of this invention was selected so that the finger and thumb holes would be drilled into the weight blocks, the minimum width for the weight blocks was selected as approximately 1.25 inches to provide enough stock for the thumb hole. The minimum length of the weight block was selected as approximately 2.5 inches to provide enough stock for the fingers and variations in spans between the fingers. The thickness dimension of 1.25 inches was selected in order to produce a weight block having a weight of approximately 100 grams or approximately 3.5 ounces.

With reference to FIG. 1, suitable indicia may be disposed at the surface of the ball in order to provide a guide for drilling. Such indicia enables the drilling operator to precisely locate the position of the finger and thumb holes so as to intersect the respective weight blocks.

Once again, the preferred embodiment of the invention has been described with reference to a three hole fingertip grip. It should be understood that the teaching of the invention is applicable to other grips utilizing various numbers of holes drilled into the ball.

While in the preferred embodiment of FIG. 2 the weight blocks 16, 18 are separated to achieve the desired span, it should be appreciated that in alternate embodiments the weight blocks may merge into a single tee-shaped configuration. Alternately the two segments may be physically distinct but interconnected either integrally or by a third element as will be described further below.

In the preferred embodiment the core 12 is shown as being substantially homogenous. It should be understood that as used herein the word "core" refers to the portion of the ball surrounded by the cover and may be homogenous or made up of several elements including inner and outer elements.

Applicant has provided a bowling ball in which weight blocks are positioned in the ball during manufacture thereof so that after drilling the grip the ball is stable when rolled down a line. Applicant's improved ball provides that any axis of the ball may be a spin axis which exhibits the desirable properties of having:

(a) moments of inertia approximately equal about the principal axes, (i.e., axes for which the moments of inertia assume extreme values) and (b) products of inertia vanishingly small about axes normal to the spin axes.

Thus, whether the bowler throws a curve, hook or any other type of trajectory the ball will exhibit stability.

It is desirable that the moments of inertia about the principal axes be approximately equal. By this it is meant the moments of inertia do not vary by more than 5%. Similarly, applicant provides that the products of inertia for all axes perpendicular to the spin axis should be vanishingly small. The optimum value for the products of inertia is, of course, zero. Applicant provides that such products of inertia should be smaller than 1% of the moments of inertia.

Description of Alternate Embodiments

Attention will now be directed to FIGS. 5–14 where alternate embodiments of the invention are shown. It should be understood that FIGS. 5–14 are schematic representations similar to FIG. 3 which show a portion of a modification of the bowling ball of this invention with respect to the relationship of the weight blocks to the finger holes and thumb holes.

In FIG. 5, the finger block 40 is oval in shape and receives the finger holes 42, 44. Thumb block 46 of FIG. 5 is also oval in shape and receives thumb hole 48. In FIG. 5, the respective finger block 40 and thumb block 46 are separated and are oriented generally parallel to one another.

The embodiment of FIG. 6 represents a slight modification to the embodiment of FIG. 5. In FIG. 6, the thumb block 46 is oriented 90 degrees relative to the position shown in FIG. 5 so as to define with finger block 40 a generally tee-shaped configuration.

Turning now to FIG. 7, the finger block 52 has a generally rectangular shape and is adapted to receive finger holes 54, 56. A thumb block 58 is provided which receives thumb hole 60. In the embodiment of FIG. 7, the thumb block 58 is oriented generally parallel to finger block 52. The two blocks are interconnected, however, by a connecting element 62.

The embodiment of FIG. 8 is similar to the embodiment of FIG. 7 except for the fact that the thumb block 58 in FIG. 8 is oriented 90 degrees relative to the position of the thumb block as shown in FIG. 7. As in FIG. 7, there is provided in FIG. 8 a connecting element 62 between the finger block 52 and thumb block 58.

The embodiment of FIG. 9 is similar to that shown in FIG. 3. In FIG. 9 there is provided a finger block 66 which is adapted to receive finger holes 68 and 70. Thumb block 72 receives thumb hole 74. While in the embodiment of FIG. 3 the finger block and thumb block are oriented in a generally tee-shaped configuration with some separation provided between the respective blocks, the embodiment of FIG. 9 provides for no such separation. Rather, in the embodiment of FIG. 9 the thumb block 72 intersects the finger block 66.

In the modification of the invention as shown in FIG. 10, the finger block and thumb block are shown integral as a single block 78 which receives finger holes 80, 82 and thumb hole 84.

The modification of the invention as shown in FIG. 11 resembles a footprint. The finger block of FIG. 11 is designated 88 and receives finger holes 90, 92. The thumb block of FIG. 11 is designated 94 and receives thumb hole 96. While there is a separation of the finger block and thumb block in FIG. 11, it should be appreciated that the respective blocks may contact one another as shown in FIG. 9, may be integral as shown in FIG. 10, or, alternately, may be interconnected by means of a connecting element as shown in FIG. 8.

In the modified form of the invention as shown in FIG. 12, three separate weight blocks are shown as opposed to the two weight block concept described with reference to the preferred embodiment. In FIG. 12, a pair of finger blocks 100, 102 each receive respective finger holes 104, 106. A thumb block 108 is provided which receives thumb hole 110. In the embodiment of FIG. 12, the respective blocks 100, 102, 108, are circular in section and are generally concentric with the respective holes drilled therein. It should be appreciated, however, that other shapes of weight blocks may be utilized in the three block concept such as, but not being limited to, oval shapes, rectangular shapes, square shapes, etc.

In the modified form of the invention as shown in FIG. 13, a two weight block structure is utilized in a two hole grip. Thus far, the invention has been described, as noted above, with reference to a three hole grip. However, as has been noted earlier, a two hole grip may be preferred by a bowler which accommodates the thumb and middle finger of the bowler. In the modified form of the invention as shown in FIG. 13, the finger block 114 receives finger hole 116. Thumb block 118 receives thumb hole 120. While a square shape is shown in FIG. 13 for the respective weight blocks, it should be appreciated that other shapes may be utilized within the spirit of the invention.

In the form of the invention as shown in FIG. 14, a single weight block is used in relation to a two hole grip. The block 124 of FIG. 14 receives finger hole 126 and thumb hole 128.

In describing the preferred embodiment of the invention it has been noted that the weight blocks are positioned in the ball in a manner so as to be intersected by the finger and thumb holes when drilled. With reference to FIG. 3, the finger holes 22, 24 are shown as being entirely received within the finger block 16. Similarly, the thumb hole 26 is shown as being entirely received within the thumb block 18. A rectangular shape in the weight blocks was selected for the preferred embodiment in order to provide for variations in the location of the finger holes and thumb hole as was discussed above in connection with FIG. 3. Thus, slight variations in the distance between the finger holes may be accommodated by the length dimension "a" in the finger block 16. Similarly, slight variations in the span dimension "c" (FIG. 3) may be accommodated by the length dimension "a" of the thumb block 18. While it is preferred that the holes drilled into the ball be entirely received by a respective weight block, it should be appreciated that a drilling error or, indeed, the grip preference of a bowler (i.e., a wide grip) may produce a structure in which the drilled holes are not entirely received by the respective weight blocks. Such a condition is shown in FIG. 15 wherein the finger block 130 is positioned to receive the finger holes 132, 134. As will be observed in FIG. 15, finger hole 132 is not entirely received within the finger block 130. A portion of hole 132 is actually defined by the core 12 (not shown in FIG. 15) as the hole 132 has not been drilled within the edges of the finger block 130. Similarly as shown in FIG. 15, the thumb block 136 is shown as having received thumb hole 138. Thumb hole 138 of FIG. 15 is not entirely received within the outer surfaces of thumb block 136 (as is the case in FIG. 3) but, rather, thumb hole 138 is somewhat displaced relative to the thumb block 136 so as to be drilled partially into the core of the ball itself.

Within the spirit of the invention should be considered weight block structures in which the drilled holes are not received entirely within the boundaries or edge surfaces of the weight blocks. Some overlap between the core of the ball and the weight block (insofar as drilling) may be accommodated by this invention. As used herein the word "intersect", when describing the relationship between a drilled hole and its respective weight block, does not literally mean that the hole must be entirely received within the confines of the weight block. Rather, applicant's concept provides that weight block be positioned in close proximity with a respective hole when drilled into the ball.

Method

This invention is also directed to a method of manufacture of bowling balls in which weight blocks are provided within the ball for the purpose of rendering the ball dynamically stable after drilling of the holes for the grip. Specifically, applicant's method contemplates the provision of weight blocks within the ball having a density with respect to the ball such that all axes of the ball may be a spin axis in which the ball's moments of inertia about axes aligned with the spin axis are approximately equal and the products of inertia for all axes perpendicular to the spin axis are small thereby producing a stable trajectory for the ball as it rolls and slides down a lane.

What is claimed:

1. An improved bowling ball exhibiting stability in the ball track when drilled comprising:

a core;

a cover surrounding said core and having an outer surface;

a pair of weight blocks disposed within said ball inward of said outer surface of said cover, one of said weight blocks being positioned to be intersected by at least one finger hole when drilled into said ball, the other of said weight blocks being positioned to be intersected by a thumb hole when drilled into said ball;

the size and location of said weight blocks being such that there is no concentrated residual weight provided by the weight blocks after drilling;

the density of said core, the density of said cover and the shape and density of said weight blocks being such that after drilling all axes of said ball may be a spin axis in which the ball's moments of inertia about axes aligned with the spin axis are approximately equal and the products of inertia for all axes perpendicular to the spin axis are small thereby producing a stable trajectory for the ball as it slides and rolls down a lane.

2. The invention of claim 1 in which one weight block is oriented generally 90 degrees relative to the other weight block producing an approximate tee configuration.

3. The invention of claim 1 in which said weight blocks are generally rectangular in section each having a length dimension and a width dimension.

4. An improved bowling ball exhibiting dynamic stability when drilled comprising:

a core having mutually perpendicular x, y and z axes;

a cover surrounding said core and having an outer surface;

a pair of weight blocks disposed within said ball inward of said outer surface of said cover, one of said weight blocks being positioned symmetrical with the plane defined by the y, z axes in a manner to be intersected by at least one finger hole when drilled into said ball, the other of said weight blocks being positioned symmetrical with the plane defined by the y, z axes in a manner to be intersected by a thumb hole when drilled into said ball;

the size and location of said weight blocks being such that there is no concentrated residual weight provided by the weight blocks after drilling;

the density of said core, the density of said cover and the shape and density of said weight blocks being such that after drilling all axes of said ball may be a spin axis in which the products of inertia for all axes perpendicular to the spin axis are small thereby producing a stable trajectory for the ball as it slides and rolls down a lane.

5. The invention of claim 4 in which said weight blocks are generally rectangular in circumferential section each having a length dimension and a width dimension.

6. The invention of claim 5 in which the width dimension of each weight block exceeds the width dimension of a hole or holes when drilled into said ball and which intersect such weight block.

7. The invention of claim 5 in which one weight block is oriented generally 90 degrees relative to the other weight block producing an approximate tee configuration.

8. The invention of claim 5 in which the length dimension of the finger hole receiving weight block exceeds the length dimension of the finger hole or holes when drilled into said ball and which intersect said finger hole receiving weight block.

9. The invention of claim 5 in which the length dimension of the finger hole receiving weight block is sufficient to permit the finger hole receiving weight block to receive at least two finger holes when drilled into said ball, said finger holes being separated by a distance.

10. The invention of claim 9 in which the length dimension of the finger hole receiving weight block exceeds the length dimension of the finger holes when drilled into said ball and the distance between such holes such that variations in said distance may be accommodated by the finger receiving weight block.

11. The invention of claim 5 in which the length dimension of the finger hole receiving weight block intersects the plane defined by the y, z axes and the width dimension of the thumb receiving weight block intersects the plane defined by the y, z axes.

12. The invention of claim 11 in which the thumb hole receiving weight block is positioned relative to the finger hole receiving weight block such that there is defined a span distance between the centerlines of the respective finger holes and thumb holes adapted to intersect the respective finger hole block and thumb hole block.

13. The invention of claim 12 in which the relative orientation of the thumb hole receiving weight block with respect to the finger hole receiving weight block is such that variations in the span distance may be accommodated by the thumb hole receiving weight block.

14. The invention of claim 13 in which the thumb hole receiving weight block is separated from the finger hole receiving weight block.

15. The invention of claim 13 in which the thumb hole receiving weight block intersects the finger hole receiving weight block.

16. The invention of claim 5 in which said weight blocks are generally square in radial section.

17. The invention of claim 5 in which the outer surface of said weight blocks is generally spherical in shape.

18. The invention of claim 5 in which the inner surface of said weight blocks is generally spherical in shape.

19. The invention of claim 5 in which said weight blocks are disposed within said ball with said outer surfaces of said blocks being positioned substantially in the same plane as the outer surface of said core.

20. The invention of claim 4 in which indicia are provided on the cover of said ball for the purpose of determining the location of finger and thumb holes to be drilled in said ball so as to intersect respective weight blocks.

21. The invention of claim 4 in which said weight blocks have substantially equal dimensions and equal weights.

22. An improved bowling ball exhibiting dynamic stability after drilling comprising:

a core;

a cover surrounding said core and having an outer surface;

weight block means disposed within said ball inward of said outer surface of said cover, said weight block means being positioned so as to be intersected by grip holes when drilled into said ball there being no concentrated residual weight provided by said weight block means after drilling;

the density of said core, the density of said cover and the shape and density of said weight block means being such that after drilling all axes of said ball may be a spin axis in which the products of inertia for all axes perpendicular to the spin axis are small thereby producing a stable trajectory for the ball as it slides and rolls down a lane.

23. The invention of claim 22 in which the ball's moments of inertia about axes aligned with the spin axis are approximately equal.

24. The invention of claim 22 in which said weight block means is defined as a pair of weight blocks, one of said weight blocks positioned to be intersected by at least one finger hole when drilled into said ball, the other of said weight blocks being positioned to be intersected by a thumb hole when drilled into said ball.

25. The invention of claim 24 in which said weight blocks are separated and are disposed in general alignment with one another.

26. The invention of claim 24 in which said weight blocks are separated with one of said weight blocks being oriented generally transverse to the other of said weight blocks.

27. The invention of claim 24 in which said weight blocks are interconnected by means of a connecting element.

28. The invention of claim 24 in which said weight blocks contact one another.

29. The invention of claim 22 in which said weight block means is defined by a single weight block which is intersected by at least one finger hole and a thumb hole.

30. The invention of claim 22 in which said weight block means is defined by three weight block elements each element being positioned to be in close proximity to a respective hole when drilled into said ball.

31. An improved bowling ball exhibiting stability in the ball track after drilling, said ball comprising:

a core;

a cover surrounding said core and having an outer surface;

a finger weight block and a thumb weight block disposed within said ball inward of said outer surface of said cover, said finger weight block and said thumb weight block being substantially rectangular in section with one weight block oriented generally 90 degrees relative to the other weight block producing an approximate tee configuration;

said finger weight block being positioned so as to be intersected by at least one finger hole when drilled into said ball, said thumb weight block being positioned to be intersected by a thumb hole when drilled into said ball;

the size and location of said weight blocks being such that there is no concentrated residual weight provided by the weight blocks after drilling;

the density of said core, the density of said cover and the shape and density of said finger weight block and said thumb weight block being such that after drilling, all axes of said ball may be a spin axis in which the ball's moments of inertia about axes aligned with the spin axis are approximately equal and the products of inertia for all axes perpendicular to the spin axis are small thereby producing a stable trajectory for the ball as it slides and rolls down a lane.

* * * * *